US005190190A

United States Patent [19]

Fudalla

[11] Patent Number: 5,190,190

[45] Date of Patent: Mar. 2, 1993

[54] MOLDABLE TWO-PART VALVE BODY

[75] Inventor: Manfred Fudalla, Leer, Fed. Rep. of Germany

[73] Assignee: Weener-Plastik GmbH & Co. KG, Weener/Ems, Fed. Rep. of Germany

[21] Appl. No.: 656,229

[22] Filed: Feb. 14, 1991

[30] Foreign Application Priority Data

Feb. 24, 1990 [DE] Fed. Rep. of Germany ..... 4005881
Jun. 6, 1990 [DE] Fed. Rep. of Germany ..... 4018147

[51] Int. Cl.[5] ..... B65D 35/56

[52] U.S. Cl. ..... 222/105; 137/512.4; 137/855; 222/212; 222/494; 222/496

[58] Field of Search ..... 222/94, 95, 105, 209, 222/212, 213, 387, 491, 494, 495, 496; 137/512.4, 855, 856

[56] References Cited

U.S. PATENT DOCUMENTS 2,599,499 6/1952 Thorstenson ..... 137/856 X
3,057,373 10/1962 Bragg ..... 137/855 X
3,269,609 8/1966 Ahrens ..... 222/464 X
4,102,476 7/1978 Loeffler ..... 222/209
4,179,051 12/1979 Thomas ..... 137/855 X
4,273,272 6/1981 Blanc ..... 222/464
4,437,490 3/1984 Demers et al. ..... 137/512.4

*Primary Examiner*—Andres Kashnikow
*Assistant Examiner*—Joseph A. Kaufman
*Attorney, Agent, or Firm*—Martin A. Farber

[57] ABSTRACT

The present invention relates to a valve body (1) for a disperser, particularly a dispenser with collapsible and elastically restorable container and with self-closing filling-material outlet and air inlet valves. In order to obtain the simplest possible manufacture and a development which is more advantageous in use, the invention proposes providing two valve body parts (2, 3) which can be attached to each other particularly by detent connection, and which form a parting plane (T) extending in the longitudinal direction of the valve body, namely a closure part (3) and a dispensing opening part (2), the filling-material outlet valve being formed by a closure member (17) which is formed, for swinging under spring action in the longitudinal direction of the valve body on the closure part (3) within the region of the parting plane (T), for closing application against a valve seat (29, 41) associated with the dispensing opening part (2).

23 Claims, 12 Drawing Sheets

II 17
1
7
3
19
20
14
5
4
9
16
15
2
II 17
7
E1
6
α
14
5
15
13
8

3
2
18
17
18 a
14
22
Xc
Xc
T
9
21
Xb
Xb
6
Xa
Xa
19
3
7
17
18
a

MOLDABLE TWO-PART VALVE BODY

FIELD AND BACKGROUND OF THE INVENTION

The present invention relates to a valve body for a dispenser, in particular a dispenser with a collapsible and elastically restorable container and with self-closing filling-material outlet and air inlet valves. In addition to this, the invention concerns a cartridge as well as a dispenser having a cartridge and a valve body.

Such a dispenser is known from PCT/CH85/00109 in which, by means of pressure built up in the container, filling material is expressed through a suction tube into a valve body and emerges from the valve body through a filling-material outlet valve. The pressure in this dispenser is produced by pressing the elastically restorable container together. After the compressing, the volume of filling material emerging through the outlet valve is replaced by air which can flow into the container through an air inlet valve. This solution has a large number of structural parts and assembly is correspondingly difficult.

Proceeding from this prior art, the object of the present invention is to provide a valve body of this type which, while being easy to manufacture, is advantageous in use.

SUMMARY OF THE INVENTION

This object is achieved in the case of the valve body according to the invention by two valve-body parts which can be attached to each other, in particular by detent connection, and form a parting plane which extends in the longitudinal direction of the valve body, namely, a closure part and a dispensing opening part, the filling-material outlet valve being formed of a closure member which is formed, in the region of the parting plane, on the closure part and is swingable under spring action in the longitudinal direction of the valve body so as to provide the closing application against a valve seat associated with the dispensing opening part.

As a result of this development, there is obtained a valve body which is particularly simple to manufacture by injection molding. It consists of merely two valve-body parts which can be placed together and together form the filling-material outlet valve. In this connection, it is advantageous to develop the valve-body parts, namely a closure part and a dispensing opening part, as a single piece. The two valve body parts can then be produced as a single injection molding which then need only be folded together so that the parting plane is formed. It is, furthermore, advantageous to form on one of the two valve-body parts a further closure member which can lie in closing application on a valve seat of an air inlet valve. The valve seat of the air inlet valve is developed by the other valve-body part. Embodiments of the invention are also provided in which the valve seat of the air inlet valve is not formed by one of the valve-body parts but by a cap or the like in which the valve-body part is received. In a dispenser equipped with a closure part according to the invention, the pressure is produced, for example, in the same way as in a squeeze bottle by the pressing together of the dispenser container. Upon this pumping process, a closed air space is formed in the dispenser by the self-closing air inlet valve, developed as non-return valve, so that the required pressure can be built up upon the pumping. The arrangement of both the filling-material outlet valve and of the air inlet valve in one valve body consisting of two valve body parts is particularly advantageous. There are then formed within the valve body channels into which the air can flow through the air inlet valve when the container restores itself. The single-piece valve body, which is, for instance, injection-molded from polypropylene, is, furthermore, preferably developed in elongated shape in order to fit in a dispenser neck. In this connection, each of the two valve-body parts, namely a closure part and a dispensing opening part, has a substantially semi-circular cross section so that the valve body forms a circular cross section. The opening plane of the closure member of the filling-material outlet valve which coincides with the parting plane between the dispensing opening part and the closure part extends approximately parallel to a center line of the dispenser. The valve body is developed so as to fit in a dispenser neck, the dispensing opening part forming flow channels together with an inner wall of the dispenser neck. For this purpose, groove-like recesses are provided on the outer wall of the valve body. These flow channels can serve to conduct filling material to the dispensing opening or else to the air inlet. If both air channels and filling-material channels are provided, they are separated from each other. The closure member of the filling-material outlet valve and/or the closure member of the air inlet valve are preferably developed as spring tongues. In particular, the spring tongue of the air inlet valve can, in this connection, also extend transverse to the longitudinal direction of the valve body. It is also contemplated to provide the closure member with a knob for the closing of a valve opening. Another development of the invention provides a closure member in which two tongues which are developed extending parallel to each other and are formed on the closure part, bear a substantially semi-spherical closure head which can enter into a complementary cup-shaped valve seat developed in the dispensing opening part. It is also contemplated to develop the closure member with a second knob for the closing of the dispensing opening of the dispensing-opening part. This dispenser opening can, in particular, be associated with a dispenser neck within which the valve body is fitted. The dispensing opening part and the closure part, also when they are developed as a single part, are preferably attached by clip to each other in installed condition. A closure member developed as closure tongue is produced by injection molding with impressed prestressing into the closed condition. In this way, a sealing of the valve is assured in the assembled condition. The air inlet valve, developed as non-return valve, preferably consists of a flexible strip-shaped section and when the vent opening is developed in and the closure part, a valve seat is formed on the dispensing opening part. The flexible strip part rests under initial stress in the closed state against said valve seat. The dispensing opening part and/or the closure part preferably form at one end a mounting seat for a suction tube and the mounting seat is connected to the flow path for the filling material, said material being preferably a fluid. Such a suction tube is of importance, in particular, when the dispenser is filled with liquid. The valve body, therefore, directly forms a mount for the suction tube. The center line of the mounting seat preferably extends parallel to the parting plane between the closure part and the dispensing opening part. The mounting seat is correspondingly developed at one end on the swung-together valve body. Upon the swinging apart of the valve body, as present in the spraying condition, the mounting opening or the developments which then form the mounting opening are located correspondingly in the center between the two parts, namely the dispenser opening part and the closure part. The valve body is, furthermore, preferably developed in such a manner that a cross-sectional surface is essentially circular in the swung-together state of the valve body; and in this connection, also initially independently of the position of the cross-sectional surface. The two valve-body parts are preferably connected by film hinges. In accordance with a preferred embodiment of the invention, the closure member of filling-material outlet valve and/or air inlet valve is attached to the valve-body part by a spring joint developed as a thinning of the material. By this thinning of the material, and despite rigid development of the closure member, a slight but sufficient restoring force can be obtained. When the valve body is developed in the manner that the filling-material outlet valve has a semi-spherical valve head which lies in a valve seat of cup shape, the valve seat, in addition to a first filling-material outlet opening, also has a second dispensing opening, both of them being adapted to be closed by the semi-spherical closure head. Upon the dispensing, the filling material flows in succession through the two openings. Another special embodiment of the invention provides parallel extending, groove-shaped recesses in the outer wall of the valve body, for forming a channel for the flow of filling material and a channel for the flow of air. The channel for the flow of filling material can also be arranged on both sides of the air-flow channel. Furthermore, it is provided that the valve-body parts, which are preferably assembled by a detent/pin attachment, have at least one transverse channel, in particular for conducting air. In order to achieve a sealing attachment to the dispenser container, the valve body has a mounting seat with which it is inserted in form-locked manner within the neck of the dispenser container. In one special embodiment in this connection, the valve seat is seated in form-locked manner with a mounting seat in a neck of an adapter which, in its turn, is inserted in a neck of the container in such a manner that between the adapter neck and the neck of the container there is a free space within which air slots which permit the venting of the bottle debouch. In one special embodiment of the valve body in which the two valve-body parts are connected by film hinge to the mounting seat, one valve-body part has a closure member, developed as a tongue, for the air inlet valve, said member extending transversely to the longitudinal direction of the valve body and intersecting the parting plane. The other valve-body part has a run-on curve associated with the tip of the tongue and which is so developed that upon the swinging together of the two valve-body parts, the tip of the tongue comes against the surface of the run-on notch, in which connection it is swung into a pre-stressed position.

The valve body described above is particularly intended for use in a dispenser having a refill cartridge. In this case, the cartridge is preferably developed as a collapsible cartridge bag. The cartridge bag is emptied by squeezing. In this connection, the invention also contemplates that the cartridge bag be received within a cartridge container and that a (vent) passage opening be developed in a cover region and in a bottom region of the unit consisting of cartridge container and cartridge bag. The unit consisting of the cartridge container and cartridge bag, therefore, has two vent-passage openings. This makes it possible to receive the cartridge container sealed all around in the dispenser, a vent opening being present above and below the region of seal. Air can then be drawn through the upper passage opening, for instance, from outside the dispenser. In this case, it is furthermore preferred that the upper vent opening be developed in an upper, substantially rigid closure part of the cartridge bag. A sealing edge of the upper part of the dispenser can act all around on this cartridge bag on the side of its circumference (in assembled state).

BRIEF DESCRIPTION OF THE DRAWINGS

The invention is further explained below with reference to the accompanying drawing which, however, shows merely illustrative embodiments. In the drawing:

FIG. 4 is a top view on the object shown in FIG. 3, seen in the direction of the arrow a;

FIG. 5*a* is a cross section through the object according to FIG. 5 along the line Va—Va;

FIG. 6*a* is a cross section through the object shown in FIG. 6 along the line VIa—VIa;

DETAILED DESCRIPTION OF THE PREFERRED EMBODIMENTS

There is shown and described—first of all with reference to FIGS. 1 to 4—a valve body 1 which can be used in particular in a dispenser, preferably a pump dispenser.

Figure 1:
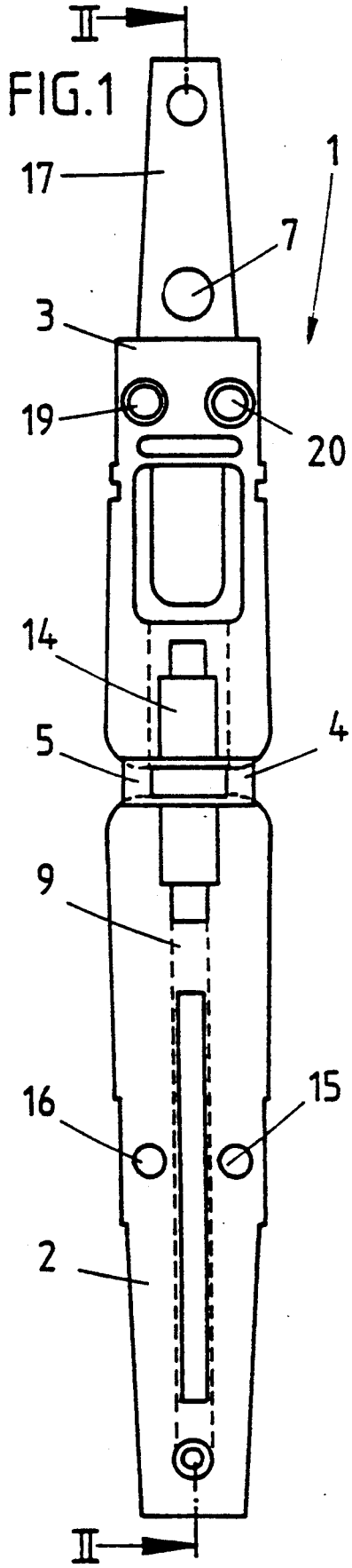
FIG. 1 is a top view of a valve body, swung open.

In FIG. 1, the valve body is shown in its swung-open position, in which position it is also injection-molded. The valve body 1 consists essentially of a dispensing opening part 2 and a closure part 3, the parts being connected to each other by film joints 4, 5 so that the valve body 1 can be injection-molded as a single part.

Figure 2:
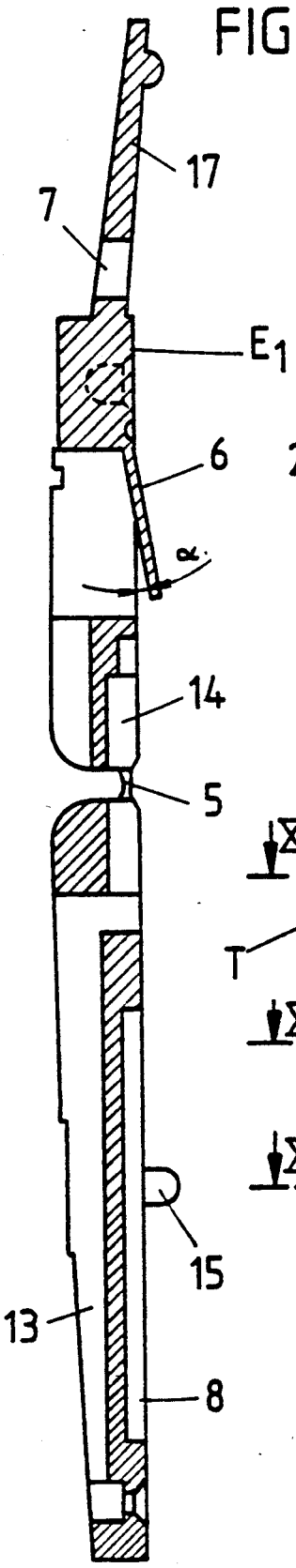
FIG. 2 is a section through the object of FIG. 1, cut along the Line II—II.

As can be noted, in particular from FIG. 2, the closure part 3 forms a non-return valve 6. This valve serves to close off a vent channel 8. As can be noted from showing of FIGS. 1-3 together, a groove-like recess 8 is developed in the dispensing opening part 2, said recess connecting the vent opening 7 with the non-return valve 6. In order that the air and possible residues of filling material can pass faster into the channel 8, the closure tongue 17 is provided with an opening 7. The non-return valve 6 lies against a valve seat 9 which is developed in the dispensing opening part 2.

Furthermore, as can be noted from FIG. 2, the non-return valve 6 is injection-molded in position protruding with respect to its closed condition so that in the closed condition (FIG. 3) there is an initial tension with which the non-return valve 6 rests against the valve seat. In the embodiment, the non-return valve 6 is injection-molded in such a manner that it forms an angle alpha of, for instance, 10° with respect to a plane E1 (which in this case coincides with the parting plane of the two valve parts 2, 3).

Furthermore, as can be seen, the valve body 1 is elongated for fitting in a dispenser head, as will be described further below with reference to FIGS. 7 and 8. The geometrical shape of the valve body is an elongated round body. Said body is longitudinally divided centrally but connected together at one end via the said film hinges 4 and 5. The vent path and the non-return valve (in the embodiments according to FIGS. 1-4, 7, 8 and 9) are developed in the plane of swing or directly adjoining it. The dispensing opening part in this connection forms a flow path in cooperation with an inner wall 10 of a dispenser neck 11. For this purpose, another groove-shaped recess 13 is developed in the dispensing opening part 2, opposite the groove-shaped recess 8. The groove-shaped recess 13, in contradistinction to the groove-shaped recess 8, is, in the closed condition, not closed off from the inside of the dispenser, but passes into a mounting seat 14 for a suction tube 15 (see in this connection, for instance, FIGS. 7 and 8). In the embodiment, a recess having the shape of a semi-cylindrical shell is provided in the dispensing opening part and in the closure part 3. These recesses debouch centrally between the film joints 4 and 5.

Furthermore, the dispensing opening part 2 and the closure part 3 can be detent-connected to each other by closure pins 15, 16 in the closed condition. A closure tongue 17 of the closure part 3, within which closure tongue the air opening 7 and a closure knob 18 are developed, is developed in freely swingable manner with an initial stress impressed in it towards the closed condition. As can be noted in particular from FIG. 2, for this purpose the closure tongue 17, in the same manner as the non-return valve 6, is injection-molded in cross section at an angle to the plane E1, also with an angle $\alpha$ of about 8°-12° in the case of the embodiment.

The non-return valve 6 consists in detail of a flexible valve strip.

In order to receive the said detent pins 15 and 16, which are arranged on both sides of the recess 8 and approximately centrally to it, there are provided in the closure part 3 corresponding pin receivers 19, 20 into which the closure pins 15, 16 are introduced in closed condition.

Corresponding to the flow path 12 for fluid to be discharged from the dispenser, the vent path, which is interrupted by the non-return valve 6, also extends towards the inside of the dispenser on the other side of the non-return valve 6, namely, in the same manner, through recesses 21, 22 open towards the outside which pass into each other. Again in cooperation with the inner wall 10 of the dispenser neck 11, a closed flow path is established also in this respect.

Figure 4:
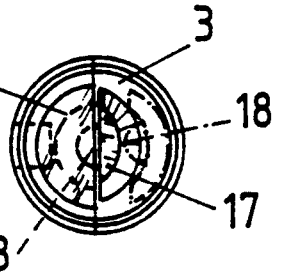
Figure 3:
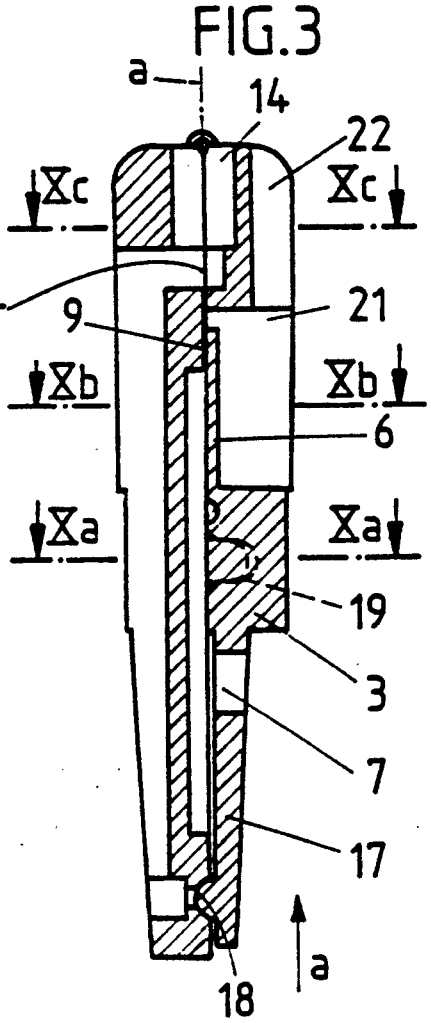
FIG. 3 is a sectional view according to FIG. 2, in closed condition.

The top view of FIG. 4 shows the movability of the closure tongue 17 between a closed position and an open position.

A center line a of the mounting seat 14 extends substantially parallel to or coincides in the embodiment shown with a parting plane T between the closure part 3 and the dispensing opening part 2.

Figure 6:
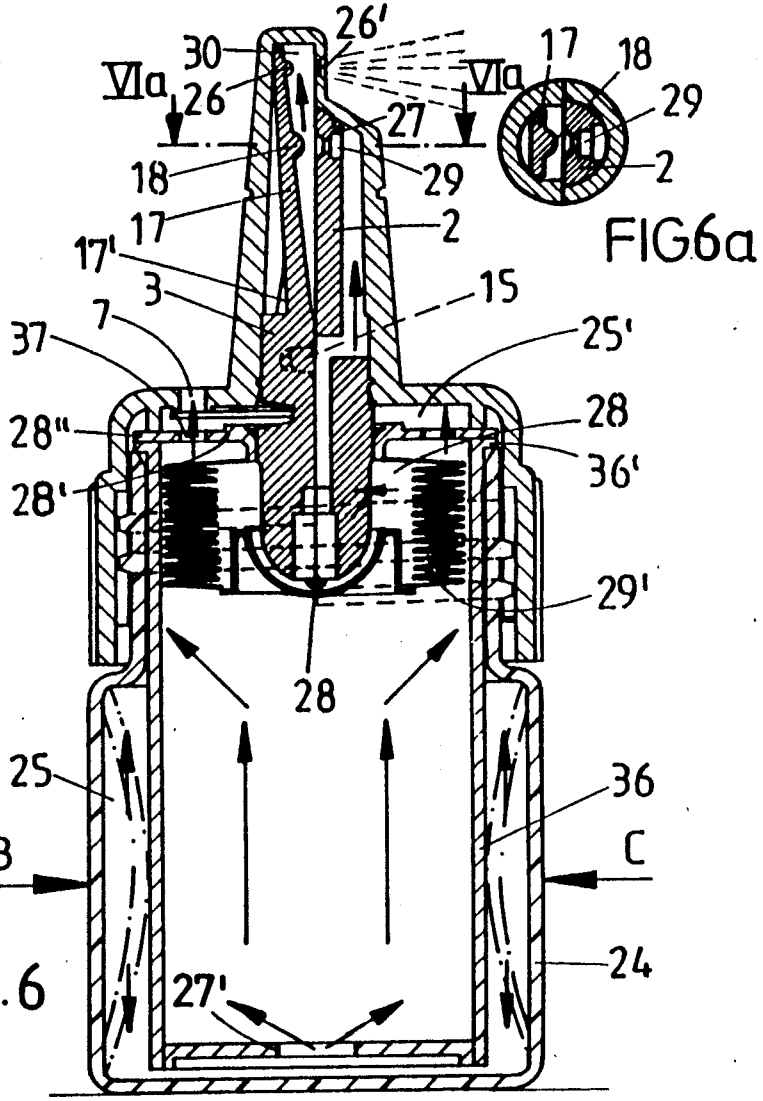
FIG. 6 is a longitudinal section corresponding to FIG. 5, in delivery condition.
Figure 5:
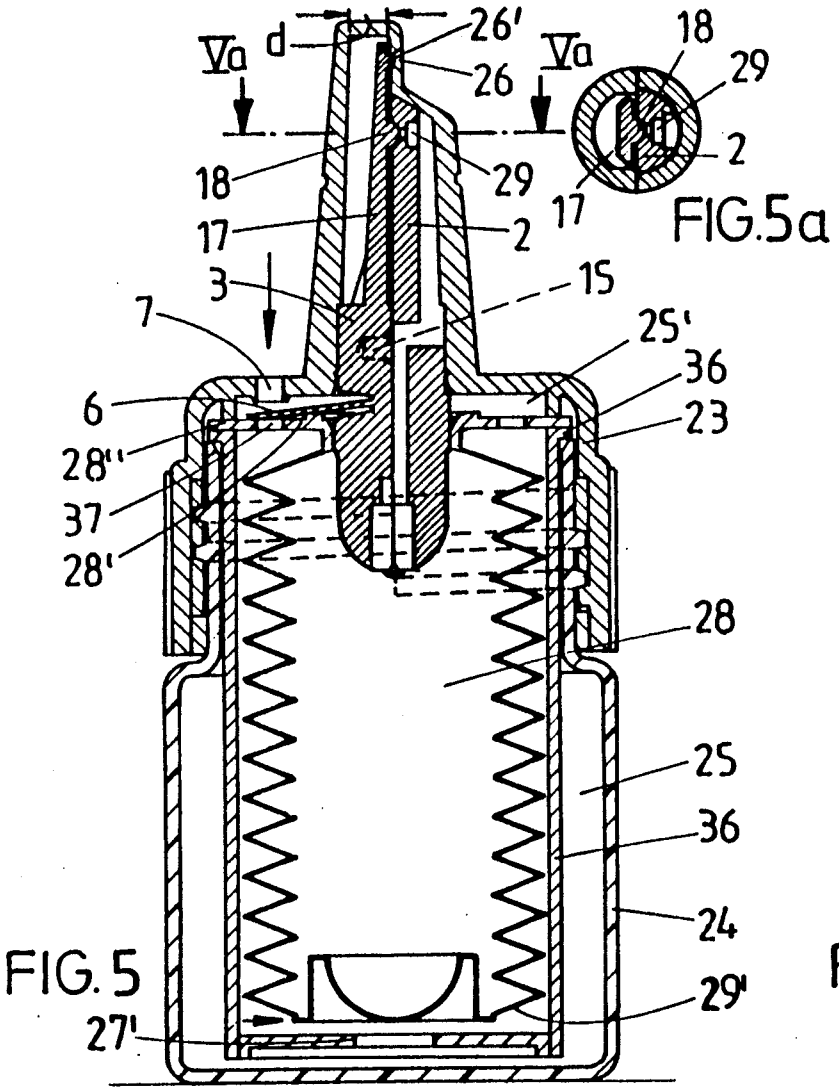
FIG. 5 is a longitudinal section through a dispenser with built-in valve body, in condition of the drawing in of air.

In the embodiments shown in FIGS. 5 and 6, the vent opening 7 is developed in a cap 23 which, together with a housing 24, forms a dispenser. The vent opening 7 is in this case covered by the non-return valve 6 which extends substantially perpendicular to the parting plane T in the embodiments being discussed. The vent path in the closure part 3 or in cooperation with the dispensing opening part 2 has accordingly been eliminated.

Furthermore, the valve body 1 of the embodiments of FIGS. 5 and 6 also has an additional closure knob 26' which closes off an outlet opening 26 of the dispenser neck 11 from the inside. The dispenser neck 11 is developed with such a large inside diameter d in the region of the outlet opening 26 and from there downward to the inside of the dispenser that the closure tongue 17 can swing unimpeded between a closed position and a dispensing position.

The head-end of the dispensing opening part 2 is developed with a surface 27 of obliquely extending cross section to rest against a section of corresponding contour of the inner wall 10 of the dispenser neck 11. The incline 27 results in damage-free introduction of the closure knob 26' upon the mounting.

The swingability of the closure tongue 17 is assured by a clear reduction in cross section between a region in which the detent pins 15, 16 and the detent-pin receiver 19, 20 are developed and the region of the closure tongue 17. In order to reinforce the transition, a rib 17' is provided. From FIGS. 5*a* and 6*a* a swinging motion of the closure tongue 17 between a closed position and a dispensing position can be noted.

The function of the dispenser shown in FIGS. 5 and 6 and of the valve body 1 which is arranged therein is as follows: In FIG. 5 the condition of suction after an expression actuation is shown. Outside air is drawn in through the vent opening 7 and permits a restoring of the dispenser housing 24 developed as a squeeze bottle, after a pump actuation. The actuation condition is shown in FIG. 6. A force which leads to a squeezing together is exerted on the dispenser housing 24, as indicated by the arrows b and c. In this way, an increase in pressure is obtained in the space 25.

This pressure acts on the cartridge 36 and into the inside of the cartridge 36 through the passage opening 27' in the bottom of the cartridge. The pressure is propagated there onto the bottom 29' of the refill package 28 and presses the latter upward. Fluid present, for instance, in the refill package presses, via the passage opening 29, the closure tongue 17 into the open position and then emerges to the outside through the opening 26 by the gap 30 created thereby. The increase of pressure in the space 24 also has the result that pressure acts from the inside against the non-return valve, so that the vent opening 7 is closed. Assurance is present that the increase in pressure is used to remove fluid from the dispenser. Between the space 25 and the space 25' there is a flow communication, not shown in detail in the drawing. When the container 24 is released from pressure, its flexible walls move back and, as shown in FIG. 5, air is again drawn in from the outside, the closure tongue 17 having at the same time immediately moved back into the closed condition shown in FIG. 5.

Figure 7:
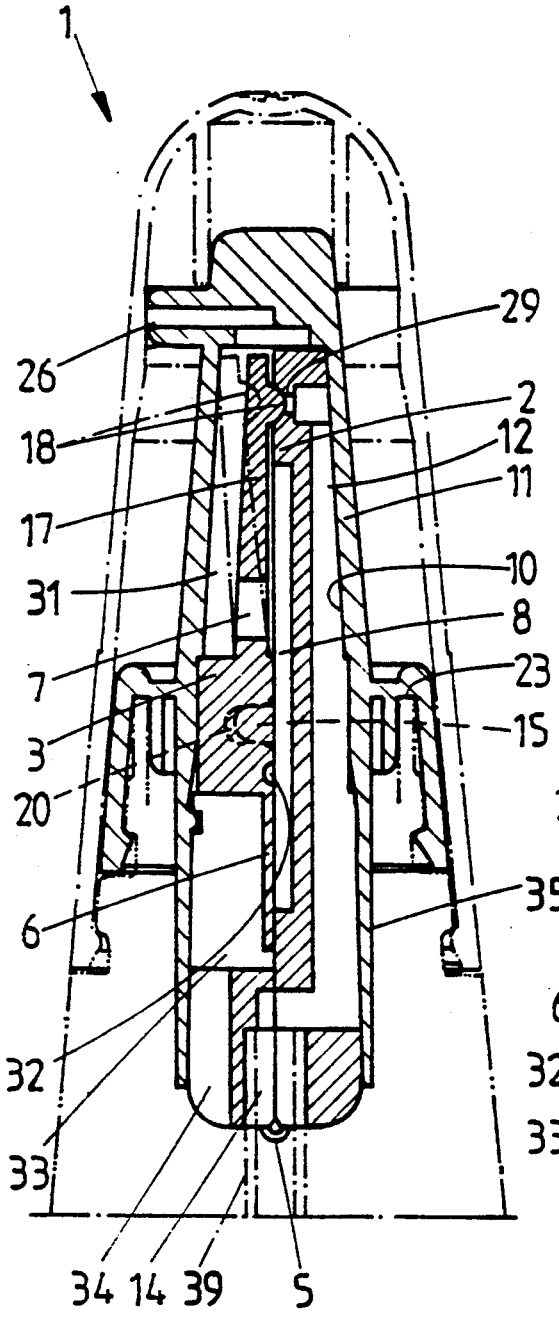
FIG. 7 is a longitudinal section through a dispenser head having a valve body with vent opening developed in the closure part.

In the embodiment in accordance with FIG. 7, the cap 33 forms a dispenser neck 11 with outlet opening 26 directed at right angle to a vertical axis of the dispenser. Otherwise there are substantially the same conditions as previously described with regard to the embodiments of FIG. 5 and FIG. 6. Here, however, the drawing in of the air is effected through the closure part 3 itself. After a reduction in pressure, the closure part 3 rests in a closing manner against the passage opening 29. At the same time, the air path from the outlet opening 26 to the inside is opened. Through the flow channel 31 between the inner wall 10 and an outer wall of the closure part 3 the air flows in the suction state further through the opening 7 and the flow path 32, formed as a result of the recess 8, to the non-return valve 6. The non-return valve 6 is lifted by the pressure and the air flows further through sections 33 and 35 of the flow path developed in the closure part 3 into the inside of the dispenser. The closure cap 23 in this connection forms a cylindrical shell 34 which is open at the bottom and extends so far that the flow path 12 is closed off from the outside. Thus, no "short circuiting" to the inside of the dispenser can take place. Rather, the content of the dispenser and, therefore, for instance a liquid, must proceed along the path through the dip tube 39. Otherwise the same function results with respect to the dispenser, which has only been partially shown in FIGS. 7 and 8, as in the dispensers which were previously described.

Figure 8:
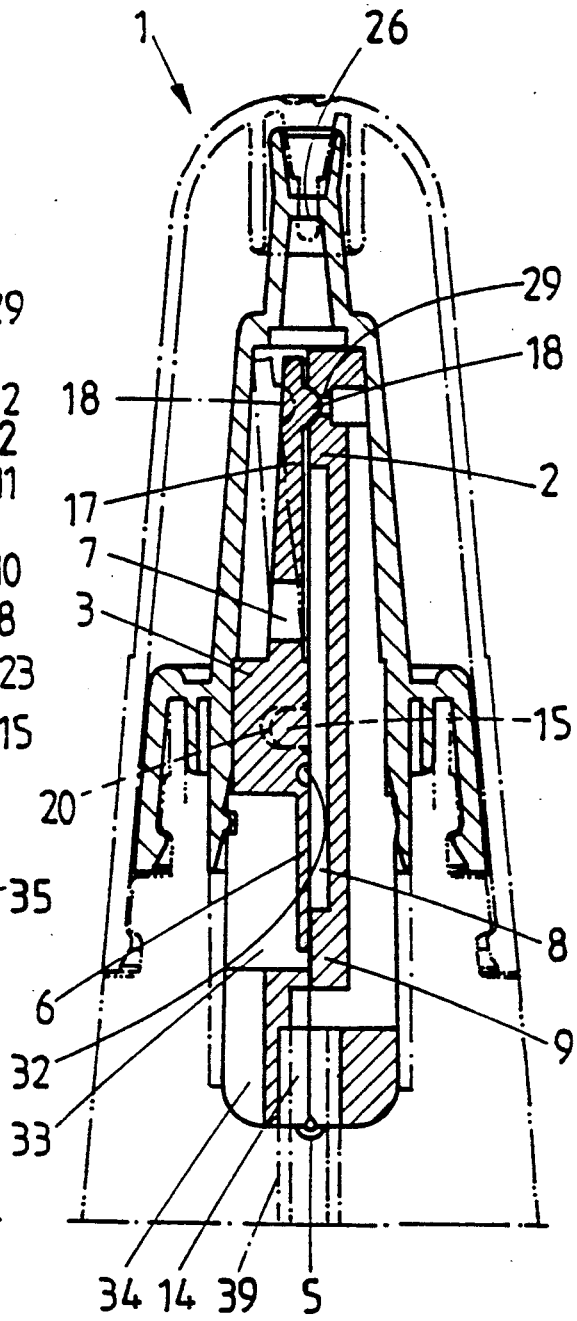
FIG. 8 is an object in accordance with FIG. 7 with a modified dispenser head.

In the dispenser of FIG. 8, differing from the dispenser of FIG. 7, there is an upward directed continuation as an extension of the flow paths 12 and 31 so that the outlet opening 26 is located approximately in the region of a center line of the dispenser or in any event in the region of the center line of the cap 23.

The cartridge 36 consists in detail of a cartridge container (indicated by the reference-numeral line of reference numeral 36) and of the refill package 28 or cartridge bag 28. The cartridge bag 28 passes into a closure part 28' which is relatively stiff. The closure part 28' lies at its edge (28'') on a circumferential rim 36' of the cartridge container and is firmly attached there to the latter, for instance bonded to it. In the closure part 28' there is an upper vent opening 37. However, it is also conceivable to provide more than merely one upper vent 37. The space between an inner wall of the cartridge container 36 and an outer wall of the cartridge bag 28 can be provided with air and air can be evacuated from it through the upper opening 37 and the lower opening 27 respectively.

Figure 9:
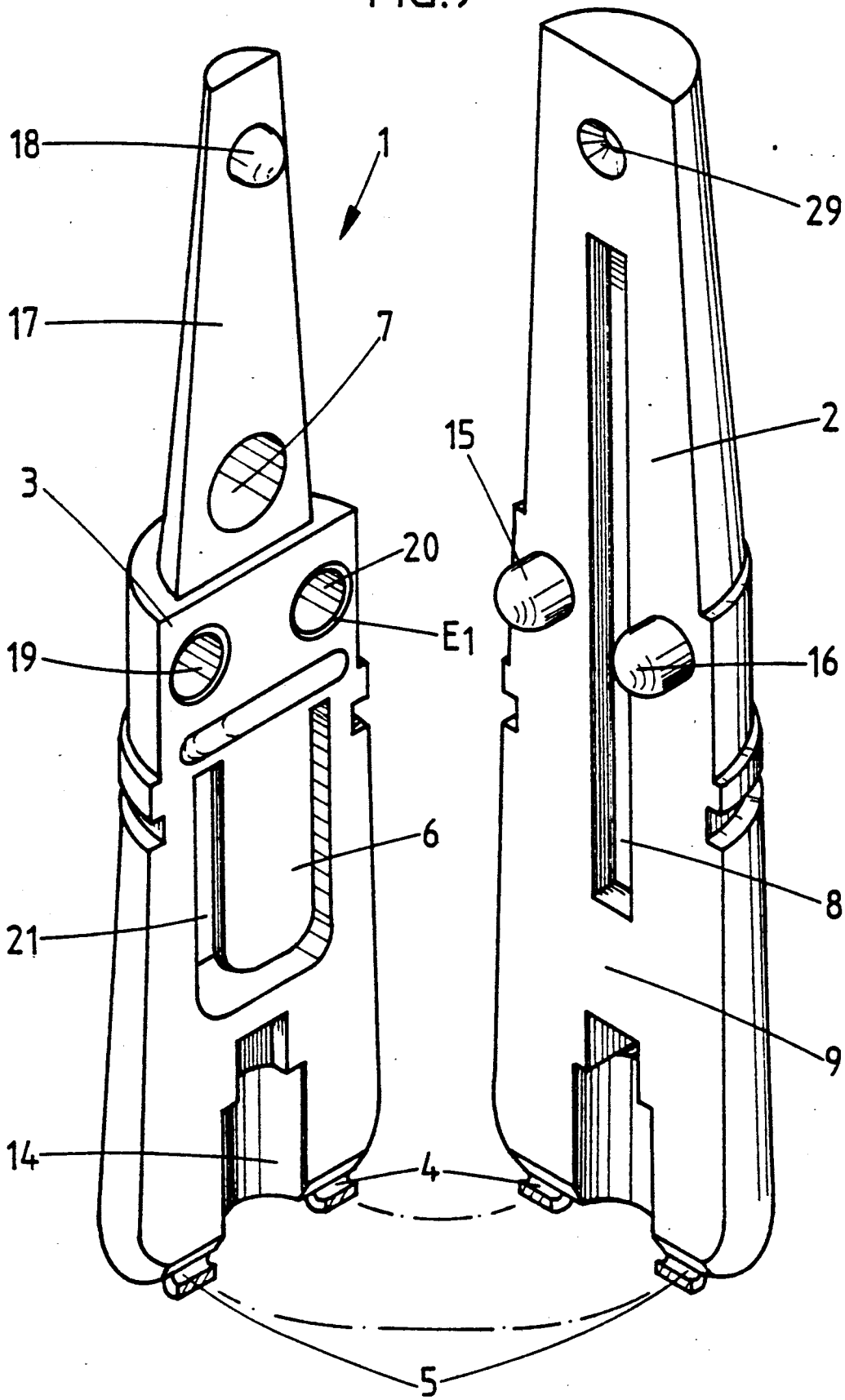
FIG. 9 is a perspective view of the valve body, in separated condition.

In FIG. 9, the valve body 1 of the embodiment according to FIGS. 1 to 4 is shown in perspective, in the condition separated from each other. With respect to the detailed description, reference is had to the description given above with respect to FIGS. 1 to 4.

Figure 10A:
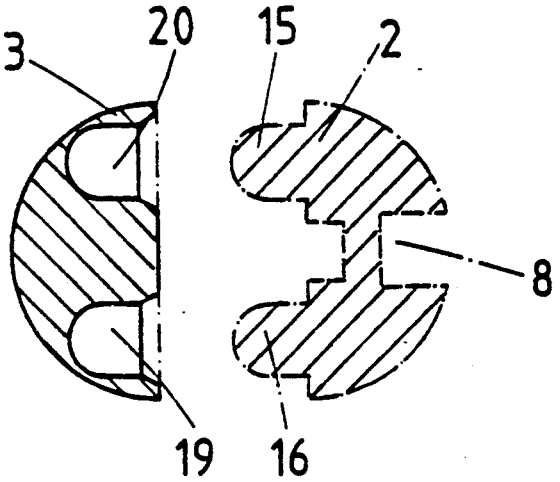
FIG. 10*a* is a cross section through the valve body according to FIG. 9, as seen in the region of the closure pin.
Figure 10B:
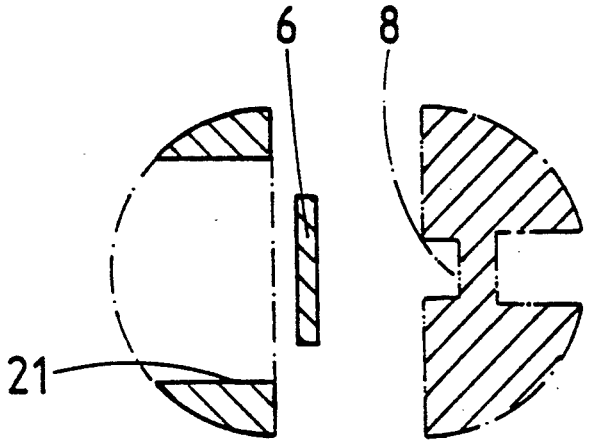
FIG. 10*b* is a section through the object of FIG. 9, as seen in the region of the closure tongue.
Figure 10C:
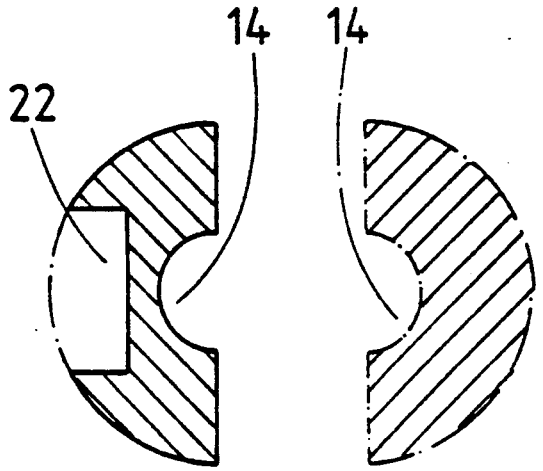
FIG. 10*c* is a section through the valve body according to FIG. 9, as seen in the region of the mounting seat for the suction tube.
Figure 11:
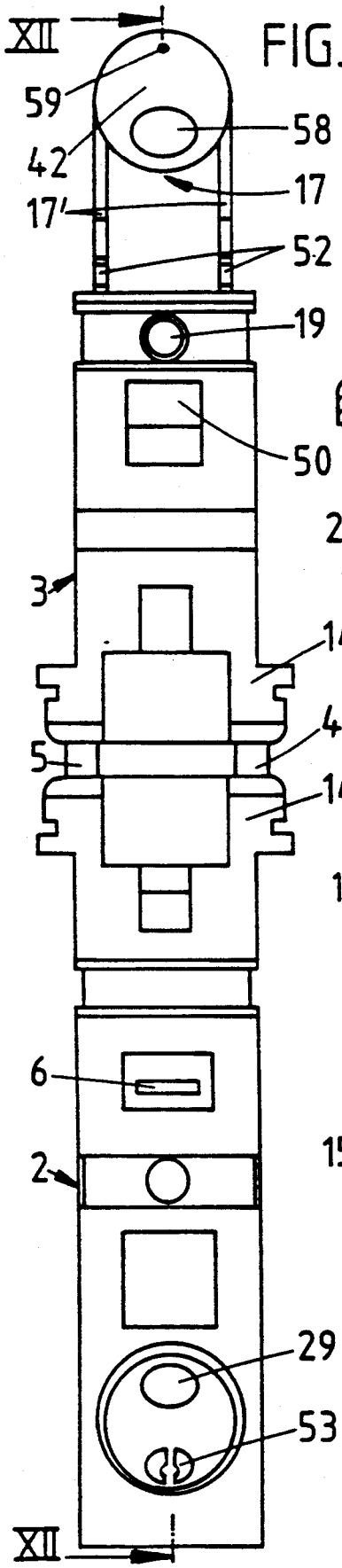
FIG. 11 is a top view on a valve body of a third embodiment shown in swung-open position.
Figure 12:
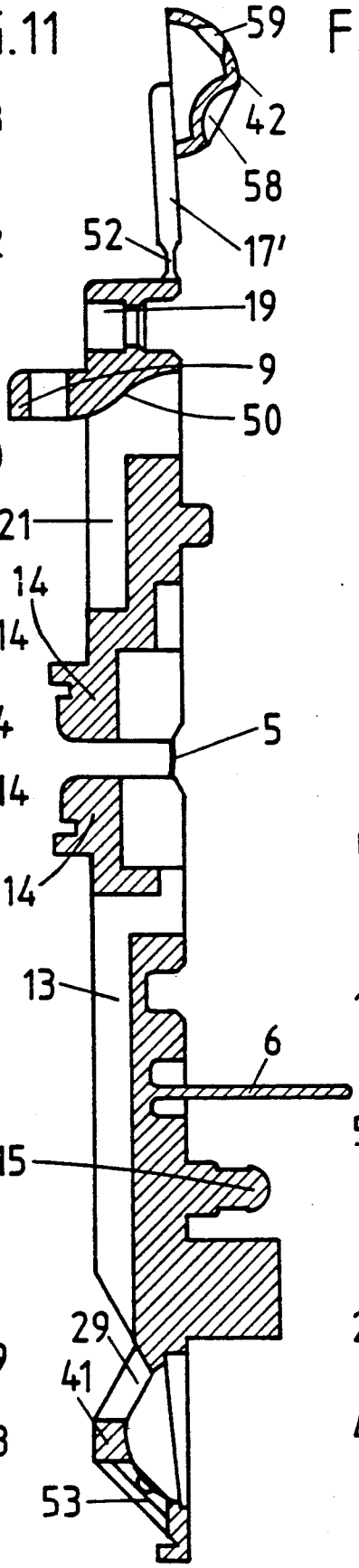
FIG. 12 is a section through the object of FIG. 11 along the line XII—XII.
Figure 13:
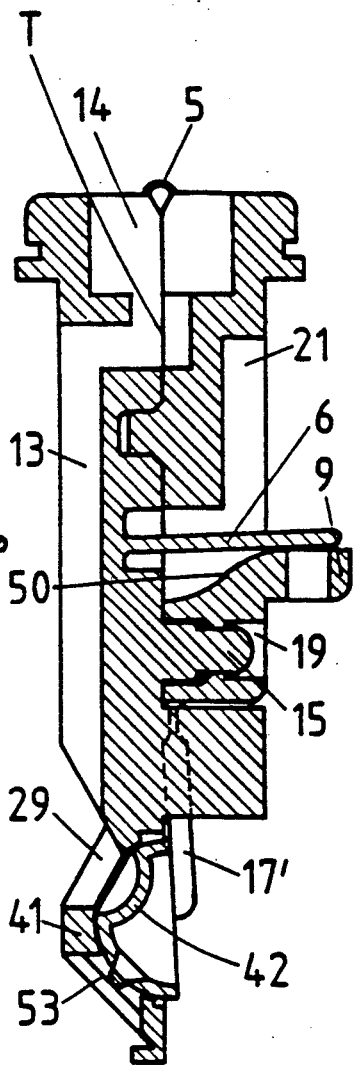
FIG. 13 is a sectional view of the object according to FIG. 11 as seen in connected condition.
Figure 14:
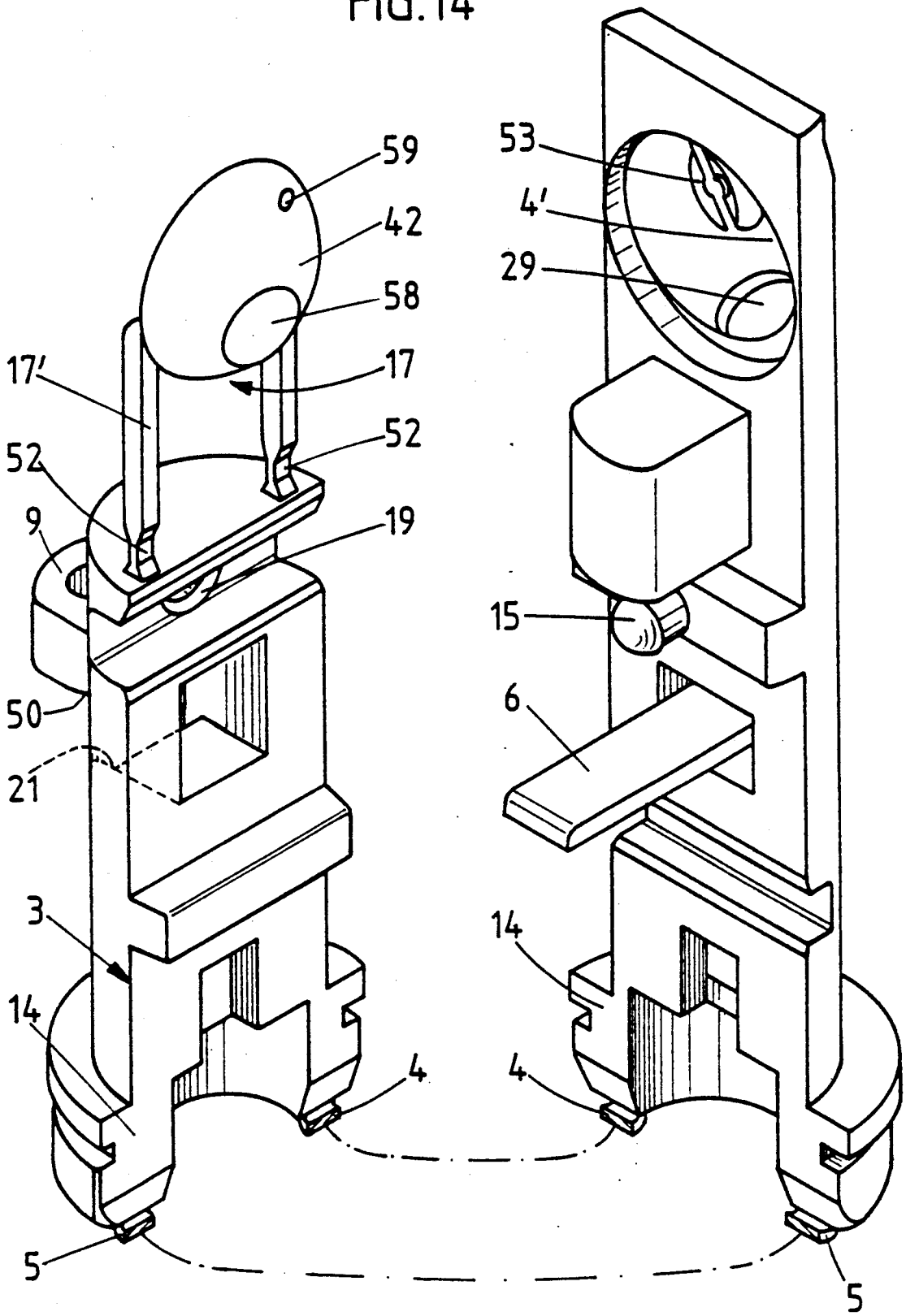
FIG. 14 is a perspective view of the two valve-body parts in accordance with the third embodiment.
Figure 16:
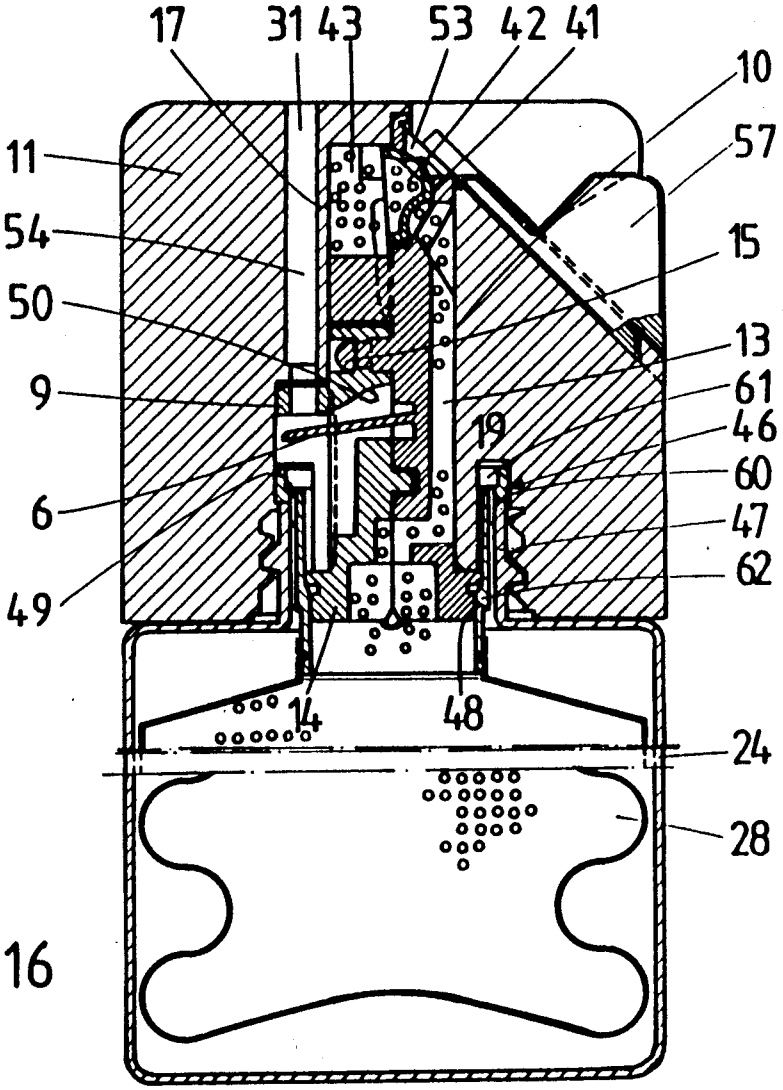
FIG. 16 is a view in accordance with FIG. 15 but in air-suction position.
Figure 15:
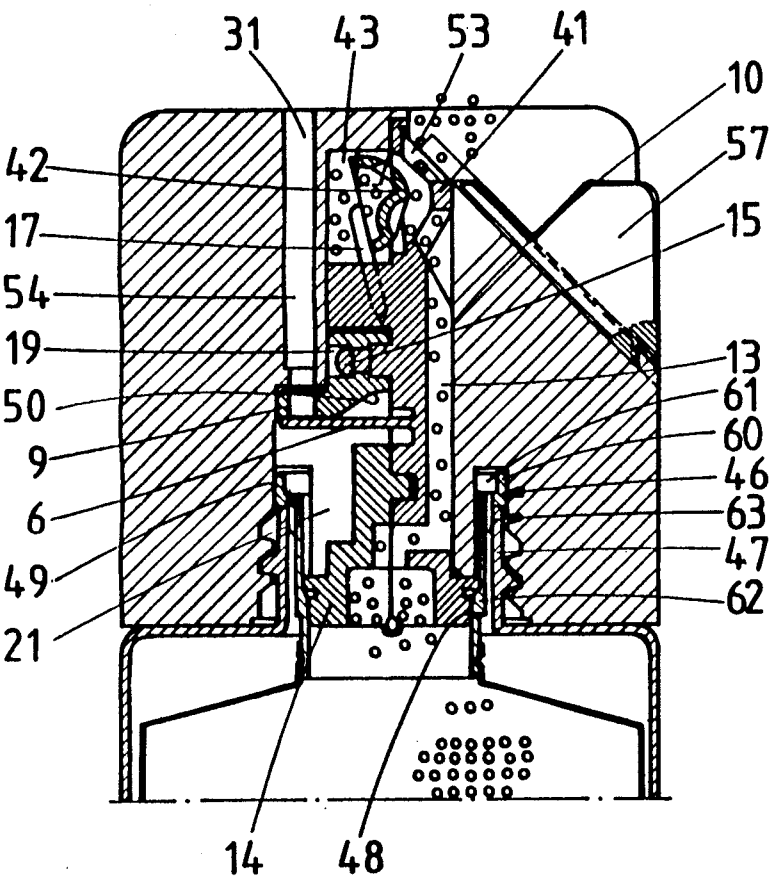
FIG. 15 is a valve body of the third embodiment inserted in a dispenser, shown in dispensing position.
Figure 17:
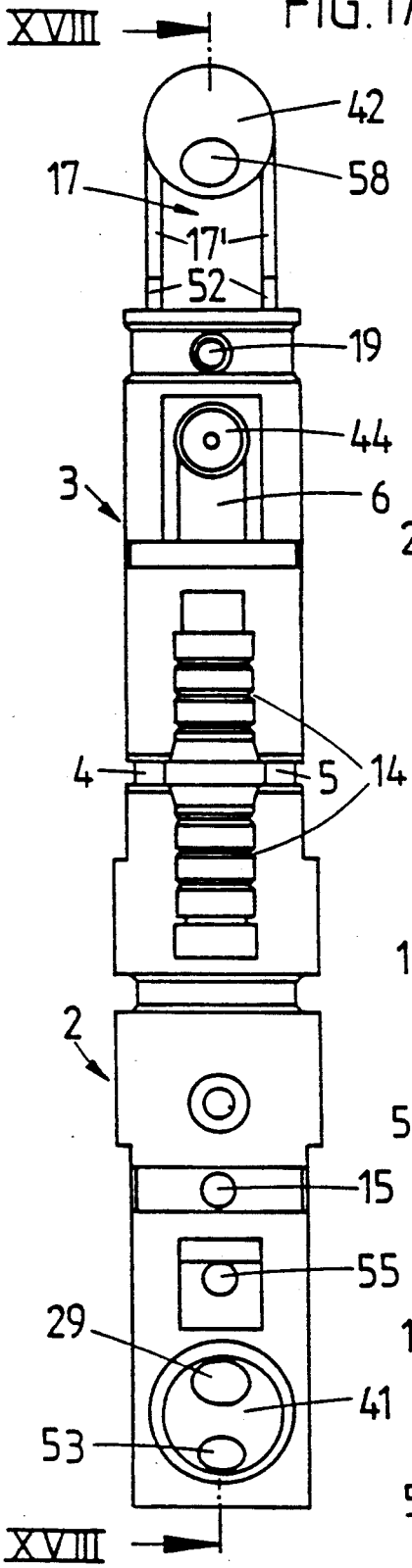
FIG. 17 is a view in accordance with FIG. 11 of a fourth embodiment.
Figure 18:
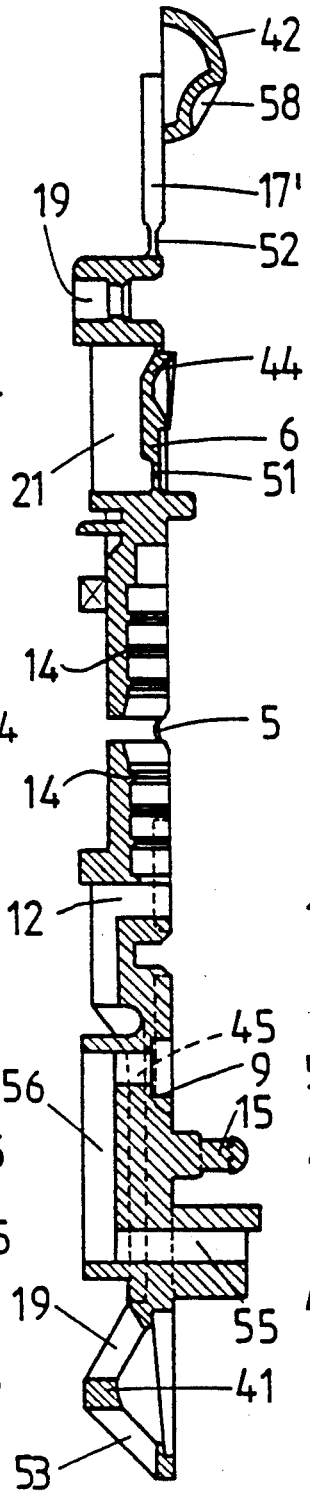
FIG. 18 is a view according to FIG. 12 of a fourth embodiment.
Figure 19:
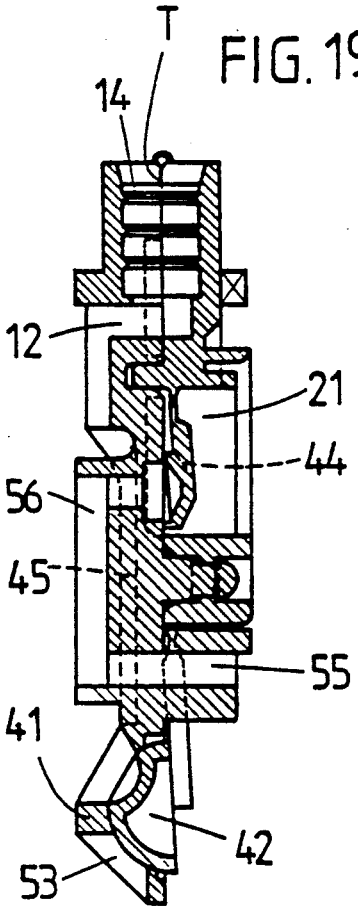
FIG. 19 is a view according to FIG. 13 of a fourth embodiment.
Figure 20:
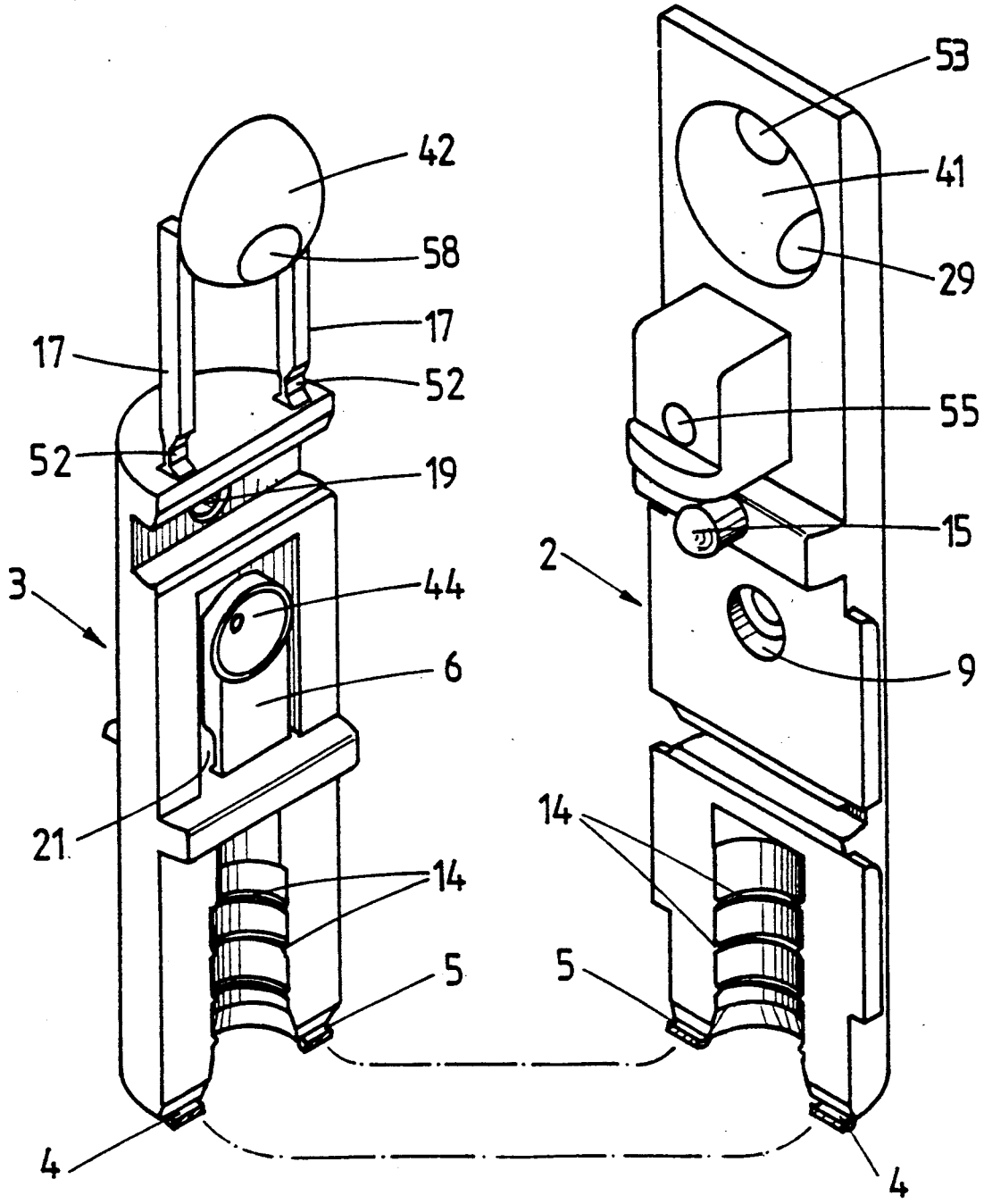
FIG. 20 is a perspective view of the two valve-body parts according to the fourth embodiment.
Figure 21:
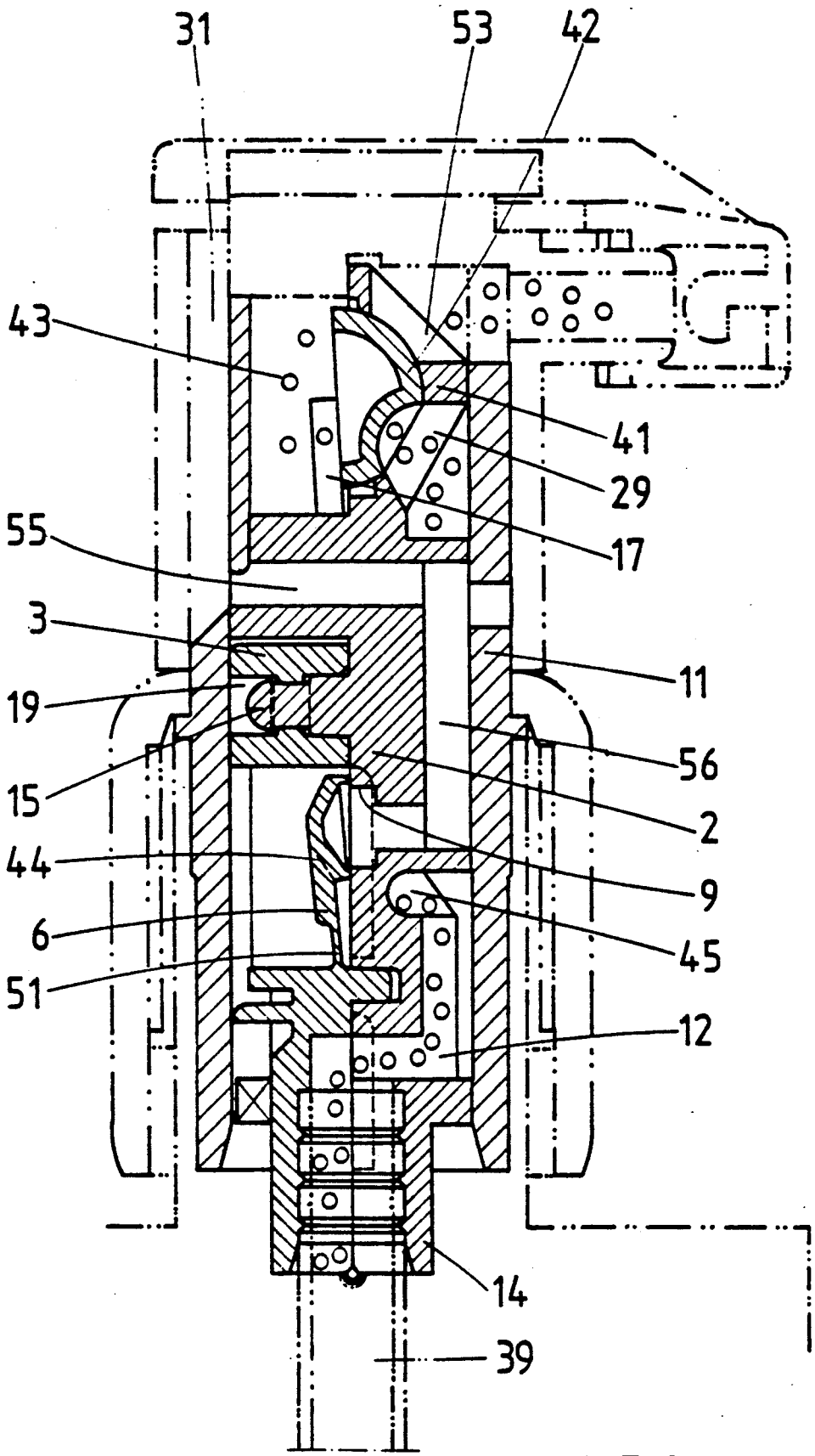
FIG. 21 is a valve body of the fourth embodiment inserted in the dispenser head.
Figure 22:
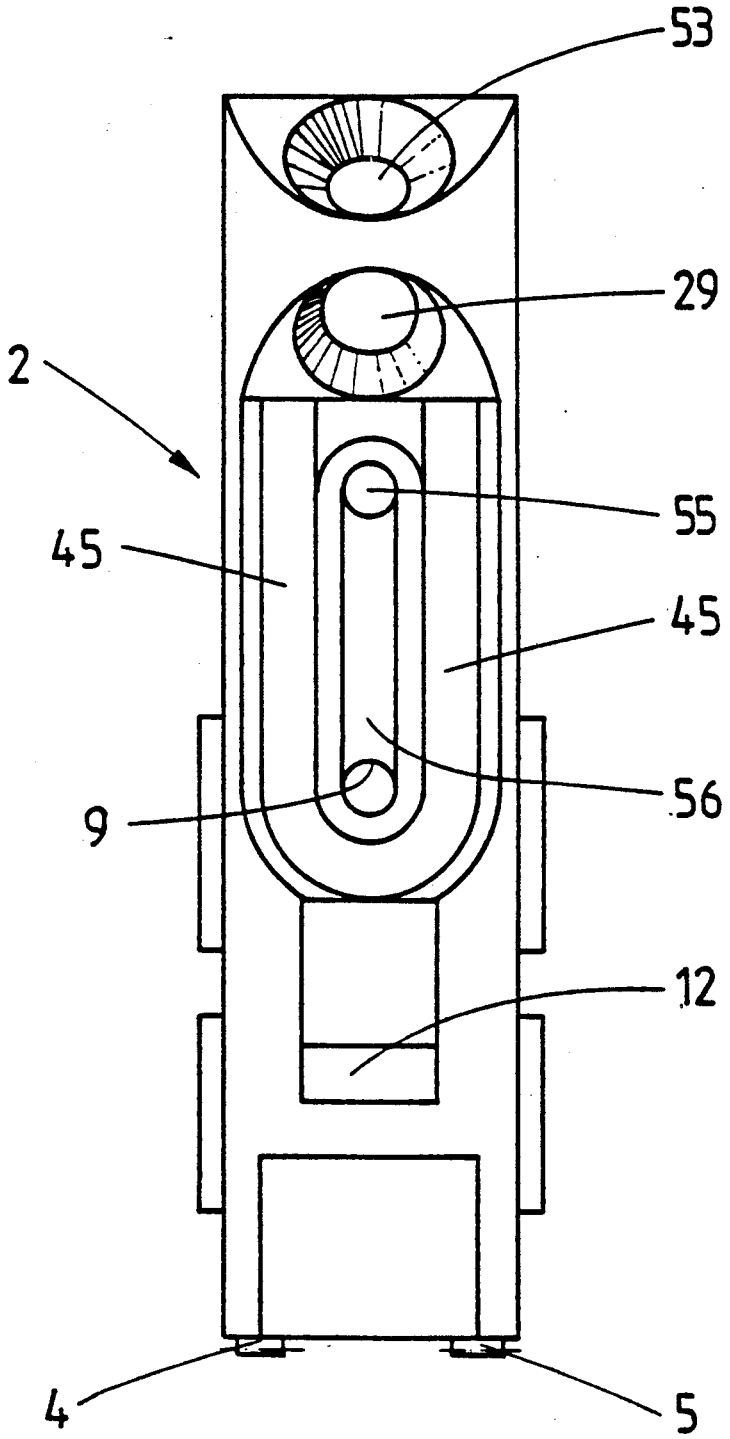
FIG. 22 is a rear view of the dispensing opening part of the fourth embodiment.

FIGS. 10–10c show different cross sections through the valve body 1 according to FIG. 9 and according to FIGS. 1 to 4. In each case, the substantially circular construction can be noted. The non-return valve part 6 can move back freely into the recess 21.

FIGS. 11–16 show a third embodiment of the valve body. The valve body 1, which consists of the two valve-body parts, the closure part 3 and the dispensing opening part 2, can be inserted into an adapter neck 48 an adapter 46 which, in its turn, is inserted into the container neck 47 (see FIGS. 15 and 16). Between the adapter neck 48 nd the container neck 47 there is a free space into which air slots 49 debouch for the venting of the container 24. To the adapter neck, there is fastened a cartridge bag 28 which is contained within a dispensing housing 24. The valve body 1 is seated in a cap which forms the dispenser neck 11 and can be closed by a pusher 57.

The valve body consists of the two valve-body parts, namely dispensing opening part 2 and closure part 3, which can be placed together and are connected together as one piece by means of film hinges 4, 5. The closure part 3 has a closure member 17 which has a semi-spherical closure head 42 which is developed by means of two tongues 17' via two spring joints 52 on the closure part 3. The semi-spherical closure head 42 is seated under initial stress in a cup 41 which forms the valve seat for the filling-material outlet valve. The cup is associated with the dispensing opening part 2 and has two openings 29, 53. The filling-material outlet opening 29 adjoins a groove-shaped recess 13 which, together with the inner wall 10 of the neck—in installed condition—forms a flow path for the filling material. The further dispensing opening 53 forms the outlet path for the filling material from the dispenser head.

If a pressure is built up within the dispensing housing 24, then the pressure continues through the flow path and acts on the closure head 42 so that the latter lifts off from the dispensing opening 29 or 53, the spring joints 52 entering into action. The closure head 42 shifts in this connection into a chamber 43. The change in volume which is thereby imposed upon the chamber 43 can be counteracted by a compensation opening 59 which is associated with the partial region of the closure head 42 which closes the dispensing opening 53. The semi-spherical closure head 24 has a trough 58 associated with the filling-material outlet opening 29. The dispensing opening 53 is developed in two parts. The two-part nature is produced by a bolt which separates the dispensing opening 53 parallel to the direction of length and, in the resting position of the closure head 42 against the sphere 41, closes off the compensation opening 49.

After the emergence of the filling material from the dispensing housing 24, the quantity displaced is replaced by air. This air flows through the flow channel 31 through the dispensing head and passes through a valve seat 9, which is associated with the closure part 3, into a recess 21 which is connected to the air slots 49 of the adapter 46. The air inlet valve formed by the valve seat 9 and a closure tongue 6 associated with the dispensing opening part 2 extends laterally out of the substantially circular valve body. The recess 21 together with the neck inner wall 10 of the dispensing neck 11 forms an air channel.

The adapter 46 forms a connecting piece for the stream of filling material from the cartridge bag 28 to the valve body 1. The valve body is seated in this connection in the neck 48 of the adapter 46, the valve body 1 resting with its mounting seat 14 on an insert seat 62 of the adapter 46. The insert seat 62 is formed in this connection by a region of the neck 48 of smaller cross section. Furthermore, the cartridge bag 28 is placed on the lower neck region of the adapter 46. The neck 48 of the adapter has a smaller outside diameter than the inside diameter of the neck 47 of the container 24. The space between the adapter neck 48 and the container neck 47 forms an air channel for the venting of the container In addition to forming the air channel, the adapter also has the task of holding the cartridge bag 28 in the container neck 47. For this purpose, the adapter has a collar 60 the diameter of which is larger than the inside diameter of the container neck 47 and which rests on the upper rim of the container neck 47. Adjoining the collar on the neck side is a flange 63 the outside diameter of which corresponds to the inside diameter of the neck 47 so that the adapter is seated, centered in form-locked fashion, within the neck. The air passage between the valve body, in this case the recess 21, and the container is formed by air slots 49 which are associated with the flange 63.

Furthermore, the adapter 46 together with its collar 60 extends into a recess of the cap 11, an annular groove 61 being formed on the collar 60 and connecting the air slots 49 with the recess 21. In this way, the vent connection between the air entrance valve and the inside of the container is assured.

It is also provided that the adapter is not centered by a flange 63 in the neck 47 of the container 24 but that the collar 60 of the adapter 46 lies in form-locked manner within an annular opening in the cap. The cap can in this connection also extend in part into the adapter neck 48.

The manufacture of the valve body is effected in the position not swung together, preferably by an automatic injection molding machine. The machine is so developed that, upon the removal of the valve-body parts from the mold, they are bent around the film hinges 4, 5 and swung together into the position shown in FIG. 13. The tip of the closure tongue 6 in this connection moves onto a run-on curve 50 of the closure part and thus comes into pre-stressed application against the valve seat 9. The connection between dispensing opening part 2 and closure part 3 is produced by the detent pin 15 which engages in a pin recess 19. The detent pin 15 is of mushroom-shaped cross section, the mushroom head having a diameter which is slightly larger than the pin recess 19.

The parting surface T formed by the two valve-bodies 2, 3 serves in this embodiment also for the separation of filling-material channels and air channels, the filling-material channels being associated with the dispensing opening part 2 and the air channels with the closure part 3.

A fourth embodiment of the valve body is shown in FIGS. 17–22. As described in connection with the third embodiment, this embodiment also has a semi-spherical closure head 42 which rests in a cup 41 and forms the filling-material outlet valve. The filling material passes through the flow path 12 into a flow path 45 which is divided up and is formed together by the inner wall of the neck and two parallel grooves, both paths combining again in front of the cup 41. These two parallel filling-material paths 45 surround an air channel 56 which adjoins the seat of the air inlet valve and debouches into a transverse channel 55 which, in its turn, debouches into an air-flow channel associated with the dispensing cap.

The air inlet valve is formed by a closure member 6, a closure flap 44 which rests against the valve seat 9 being formed on a closure tongue. The closure member 6 is connected by a spring joint 51 to the closure part 3. Both filling-material outlet valve and air inlet valve are formed in the parting plane T. The air inlet channel in this connection intersects the parting plane twice, once with the formation of the valve seat and again through a transverse channel 55 which is connected with the flow channel 31 and with the air channel 56. The transverse channel 55 in this connection passes through a free space formed by the closure member tongues 17'. Also in this version of the valve body, grooves arranged on the valve-body surface form, in cooperation with the inner wall 10 of the dispensing neck 11, grooves in which air or filling material is transported.

Furthermore, the general or not especially repeated statements with regard to one embodiment also apply to the other embodiments insofar as they are not clearly differentiated by in each case the special description or the showing in the drawing.

The features of the invention disclosed in the above specification or the drawing and claims may be of importance both individually and in any desired combination for the invention.

I claim:

1. A valve body for a dispenser, including a dispenser having a collapsible and elastically restorable container of a filling material to be dispensed, the valve body comprising:

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat;

the closure part and the dispensing opening part being formed as a unitary structure; and said air inlet valve comprises a valve seat and a closure member for contacting the valve seat of the inlet valve, the valve seat of the inlet valve being formed within one of said valve body parts, and the closure member of the inlet valve being formed as a portion of the other of said valve body parts.

2. A valve body, according to claim 1, wherein each of the valve body parts have essentially a semi-spherical cross-sectional surface, and the valve body is substantially circular in cross section.

3. A valve body, according to claim 1, wherein at least one said closure members comprises a spring tongue.

4. A valve body, according to claim 3, wherein the tongue extends transversely to the longitudinal direction of the valve body.

5. A valve body, according to claim 1, wherein: a closure member of the inlet air valve comprises a closure flap formed on one end of a resilient tongue.

6. A valve body, according to claim 1, wherein a knob is formed on the closure member for the closing of a valve opening.

7. A valve body, according to claim 1, wherein the closure member of the filling-material outlet valve forms a second closure knob for the closing of a dispensing opening of the dispenser.

8. A valve body, according to claim 1, wherein the closure member of each of said inlet and said outlet valves is injection-molded with an impressed initial stressing into a closed condition.

9. A valve body, according to claim 1, wherein said outlet valve is operative with a suction tube, there being a flow path connecting the suction tube to the outlet valve; and at least one of the dispensing opening part and the closure part form a mounting seat for receiving the suction tube, the mounting seat being connected to the flow path.

10. A valve body, according to claim 9, wherein a center line of the mounting seat extends substantially parallel to said parting plane between the closure part and the dispensing opening part.

11. A valve body, according to claim 1, wherein the closure member of said inlet valve is attached to one of the valve-body parts by a spring joint, the spring joint being a part of the one valve-body part and being developed as a thinning of the material.

12. A valve body, according to claim 1, further comprising a detent pin and pin recesses, wherein the two valve-body parts are connected by the detent pin upon engagement of the pin by detent in the pin recesses.

13. A valve body, according to claim 1, further comprising film hinges, wherein valve-body parts are connected by the film hinges.

14. A valve body, according to claim 1, wherein the valve body is operative to be coupled by an adapter to a container by insertion of the valve body into an adapter neck of the adapter, the adapter being insertable in its turn by means of its adapter neck into a neck of the container; the adapter comprises a collar formed on the adapter neck on a valve body insertion side of the adapter neck, a flange providing a lock in the upper region of the container neck; and the collar is formed on the flange and rests on a rim edge of the container neck, there being air slots at the collar debouching into a free space between adapter neck and container neck.

15. A valve body according to claim 14, wherein the adapter collar rests on a rim of the container.

16. A valve body according to claim 15, further comprising a cup encircling the valve body; and wherein the adapter is centered by means of the collar in the cap.

17. A valve body according to claim 14, wherein the adapter includes an insert seat formed by a region of the adapter neck of reduced cross section for receiving the valve body.

18. A valve body for a dispenser, including a dispenser having a collapsible and elastically restorable container of a filling material to be dispensed, the valve body comprising:

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat;

the valve body is developed to fit in a dispenser neck; and groove-shaped recesses are disposed in an outer wall of the valve body to form channels with an inner wall of the dispenser neck.

19. A valve body for a dispenser including a dispenser having a collapsible and elastically restorable container of a filling material to be dispensed, the valve body comprising:

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat;

the closure part and the dispensing opening part being formed as a unitary structure;

said air inlet valve comprises a valve seat and a closure member for contacting the valve seat of the inlet valve, the valve seat of the inlet valve being formed within one of said valve body parts, and the closure member of the inlet valve being formed as a portion of the other of said valve body parts; and the closure member of said air inlet valve comprises two parallel extending tongues which are formed on the closure part and which bear a substantially semi-spherical closure head, the valve seat of the inlet valve being cup-shaped and formed in the dispensing opening part and conforming in shape to said head.

20. A valve body for a dispenser including a dispenser having a collapsible and elastically restorable container of a filling material to be dispensed, the valve body comprising:

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat; and the seat of the outlet valve is cup-shaped, and comprises a dispensing opening.

21. A valve body, according to claim 20, wherein the seat of the outlet valve comprises a bridge of material which divides the dispensing opening in two.

22. A valve body for a dispenser including a dispenser having a collapsible and elastically restorable container of a filling material to be dispensed, the valve body comprising;

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat;

the closure part and the dispensing opening part being formed as a unitary structure;

said air inlet valve comprises a valve seat and a closure member for contacting the valve seat of the inlet valve, the valve seat of the inlet valve being formed within one of said valve body parts, and the closure member of the inlet valve being formed as a portion of the other of said valve body parts; and the valve body further comprises groove-shaped recesses in an outer wall thereof, the recesses extending at least in part in parallel, for formation of channels coupled to said outlet and said inlet valve for flow of the filling-material and the air.

23. A valve body for a dispenser including a dispenser having a collapsible and elastically restorable container of a filling material to be dispensed, the valve body comprising:

a self-closing filling-material outlet valve and a self closing air inlet valve;

two valve-body parts which form a parting plane extending in a longitudinal direction of the valve body;

means for connecting a first of said valve-body parts to a second of said valve-body parts, said first valve-body part being a closure part and said second valve-body part being a dispensing opening part;

wherein the filling-material outlet valve comprises a valve seat formed within the dispensing opening part, and a closure member which swings resiliently on the closure part in the longitudinal direction of the valve body at the parting plane for closing against the valve seat;

the closure part and the dispensing opening part being formed as a unitary structure;

said air inlet valve comprises a valve seat and a closure member for contacting the valve seat of the inlet valve, the valve seat of the inlet valve being formed within one of said valve body parts, and the closure member of the inlet valve being formed as a portion of the other of said valve body parts;

the valve body is operative, by means of an adapter, to be connected to a cartridge bag and for holding and reception of the cartridge bag within a container having a container neck;

the adapter has centering means for centering with respect to the container neck, leaving axial air channels between the container neck and a neck of the adapter.

* * * * *